US006684454B2

(12) United States Patent
Ehrenreich

(10) Patent No.: US 6,684,454 B2
(45) Date of Patent: Feb. 3, 2004

(54) SUPPORT MECHANISM FOR TILTED WINDOW SASH

(76) Inventor: Matthew Ehrenreich, 300 S. Central Park Ave., Hartsdale, NY (US) 10530

( * ) Notice: Subject to any disclaimer, the term of this patent is extended or adjusted under 35 U.S.C. 154(b) by 121 days.

(21) Appl. No.: 10/024,820

(22) Filed: Dec. 18, 2001

(65) Prior Publication Data

US 2003/0121123 A1 Jul. 3, 2003

(51) Int. Cl.[7] ..... E05F 3/00

(52) U.S. Cl. ..... 16/197; 16/196; 16/198; 49/151; 49/150

(58) Field of Search ..... 16/197, 196, 198; 49/151, 150, 429, 430

(56) References Cited

U.S. PATENT DOCUMENTS

| | | | | | |
|---|---|---|---|---|---|
| 198,553 | A | | 12/1877 | Von Aver | |
| 1,988,049 | A | | 1/1935 | Reiner | 292/264 |
| 2,820,981 | A | | 1/1958 | Klee | 16/63 |
| 2,917,791 | A | | 12/1959 | Klein | 20/42 |
| 3,331,161 | A | | 7/1967 | Ruff | 49/397 |
| 3,600,855 | A | * | 8/1971 | Starck et al. | 49/51 |
| 3,897,966 | A | | 8/1975 | Draughon | 292/264 |
| 4,783,131 | A | * | 11/1988 | Grass | 312/276 |
| 5,530,991 | A | * | 7/1996 | deNormand et al. | 16/198 |
| 5,581,941 | A | * | 12/1996 | Sill et al. | 49/246 |
| 5,737,877 | A | * | 4/1998 | Meunier et al. | 49/445 |
| 6,467,128 | B1 | * | 10/2002 | Damani | 16/197 |

* cited by examiner

*Primary Examiner*—Gary Estremsky
*Assistant Examiner*—Mark Williams
(74) *Attorney, Agent, or Firm*—Leonard Cooper

(57) ABSTRACT

A cord tensioned by a spring supports the sash of a hung window in a stationary position while the sash is tilted for cleaning. The cord pulls a pulley attached to the spring which extends as the sash is further tilted. A tubing houses the spring and pulley and provides a stop that limits the maximum tilt of the sash.

15 Claims, 7 Drawing Sheets

Fig. 5
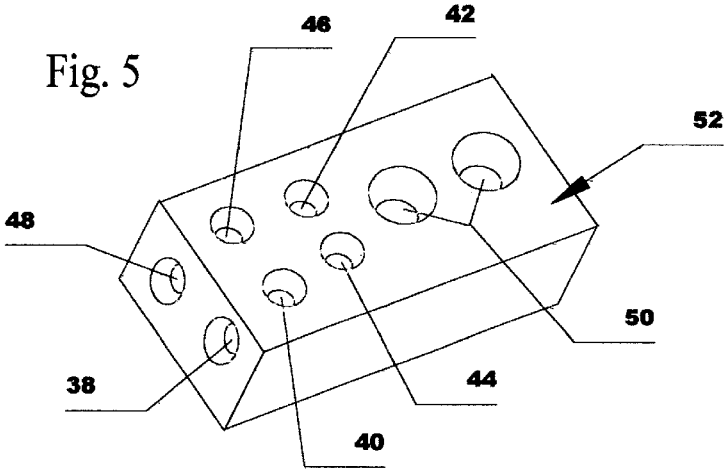
Fig. 6
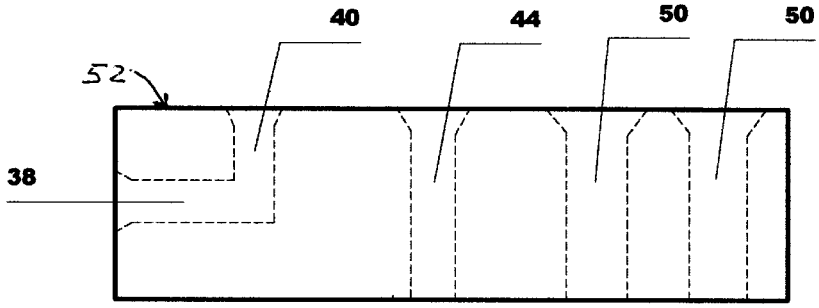
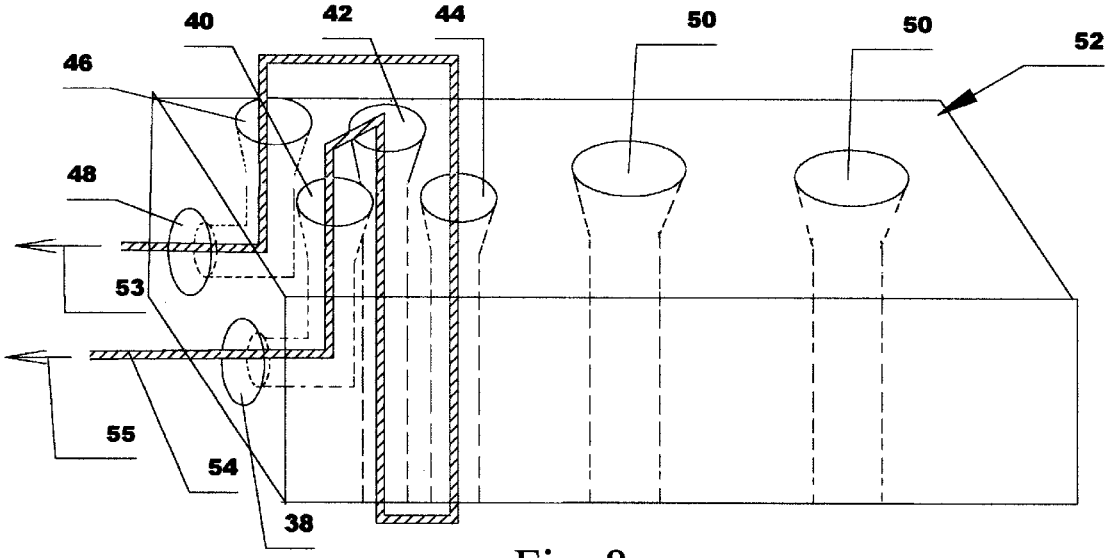
Fig. 8

SUPPORT MECHANISM FOR TILTED WINDOW SASH

BACKGROUND OF THE INVENTION

Hung windows that tilt in for cleaning have a problem in that the tilted sash needs support during the cleaning process. Thus extra props must be utilized, or the worker supports the tilted sash by hand. Then both hands are not available for cleaning. Additionally, in many conventional constructions, an overly tilted sash will entirely separate from the window frame—with possibly harmful results.

Further, when returning a tilted sash to the vertical position, a failure to properly latch the sash may allow the sash to freely fall to a fully tilted position or even separate from the window frame—again with possibly harmful results.

SUMMARY OF THE INVENTION

The general objective of this invention is to provide a device that will support a tilt-in type window sash in a relatively horizontal position and leave both hands free to wash the outer window pane. A secondary object of this device is one of safety. The sash is prevented from falling dangerously into the interior of the house if the sash is not returned to its proper position after tilting.

A mechanism that is placed in the upper portion of the inner track of a conventional tilt-in type double hung window, supports a tilted-in window sash in varying wash positions. This device includes a tube with a small cylinder inserted into each end; the cylinders have openings to accept a mounting screw that attaches the tube to the window jamb. Within the tube is an extension spring. The top of the spring is attached to the top cylinder; the bottom of the spring is attached to a pulley, which moves through the tube as the device is operated.

A strong flexible cord is attached at one end to the bottom of the tube. It then passes through the tube, around the pulley, and then out of the tube through a hole in the bottom cylinder. The other end of the cord attaches to a mounting block, which is, in turn, attached to the sash. The design of the mounting block facilitates adjusting the maximum tilt of the sash. To set the maximum tilt, the window sash is first moved to the lowest desired tilt-and-wash position. Excess cord is then pulled through the mounting block until the spring in the tube is extended to the length of the tube. The mounting block automatically locks the cord at this position. Because the device is intended to work in a pair, one on each side of the sash, this cord length adjustment ensures that the springs on each side of the sash and the cords attached to them will be under equal tension, thus supporting the sash equally on each side. The spring tension will support the sash stationary at angles from vertical to the maximum tilt that was set through this cord adjustment. The sash's weight keeps the sash at the tilted position in opposition to the spring tension.

BRIEF DESCRIPTION OF THE DRAWINGS

There are shown in the drawings embodiments that are presently preferred. It should be understood, however, that the invention is not limited to the precise arrangements and instrumentalities shown, wherein:

FIG. 5 is a top perspective view of a sash-mounting block of the tilted window sash support mechanism of FIG. 1;

FIG. 6 is a side elevation view of the block of FIG. 5;

FIGS. 7 and 8 are enlarged views showing a path for the cord in the block of FIGS. 5, 6;

DESCRIPTION OF PREFERRED EMBODIMENTS

Figure 1:
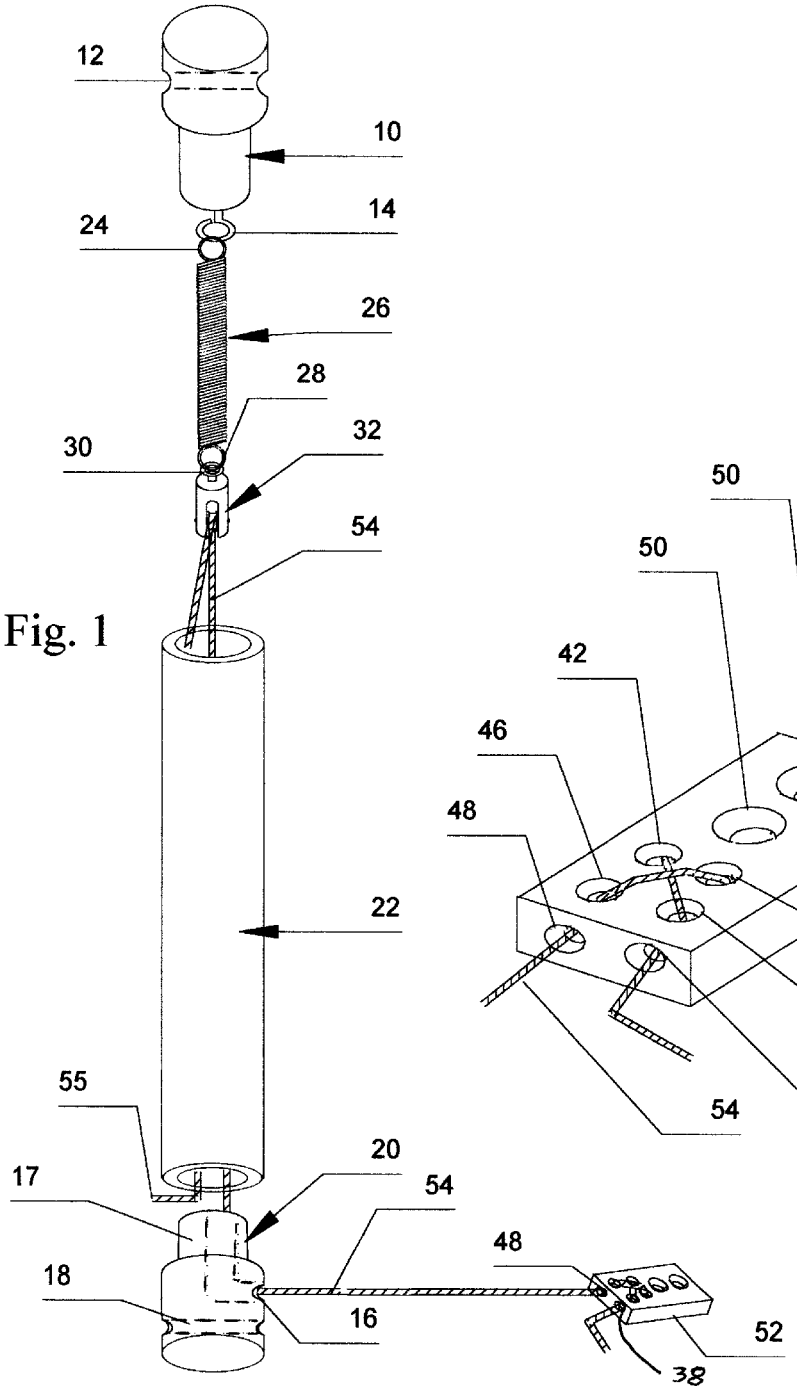
FIG. 1 is a top perspective exploded view of a tilted window sash support mechanism in accordance with the invention.
Figure 2:
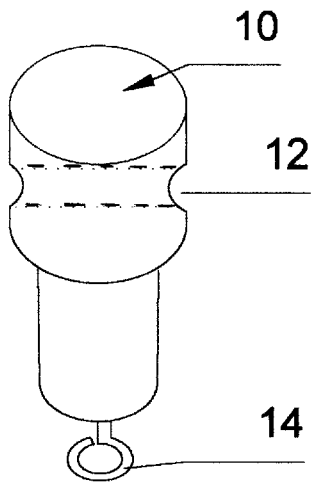
FIG. 2 is a top perspective view of a top-mounting stopper of a tilted window sash support mechanism of FIG. 1.

FIG. 1 shows the top-mounting stopper 10, which is tapered from its midpoint so that one end 11 fits into the top of the main tube 22. The top mounting stopper 10 has a hole 12 (FIG. 2) through it that is used to mount the invention to the window jamb 64 (FIG. 9) and an eyelet 14 attached at the bottom of the top-mounting stopper 10.

Figure 3:
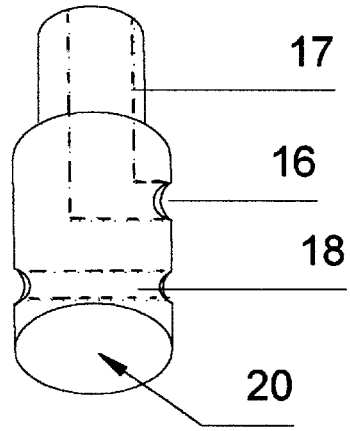
FIG. 3 is a bottom perspective view of a bottom-mounting stopper of a tilted window sash support mechanism of FIG. 1.

FIG. 3 shows the bottom-mounting stopper 20 with a mounting hole 18 through it and an outlet hole 16 drilled only through one side directly above mounting hole 18. The bottom-mounting stopper is tapered at the end 17 above outlet 16 so that it fits within the bottom of the main tube 22, which houses the inner components.

The extension spring 26, whose diameter is slightly smaller than the inner diameter of the main tube 22, slides easily within the main tube 22. It has a top eyelet 24 and a bottom eyelet 28.

Figure 4:
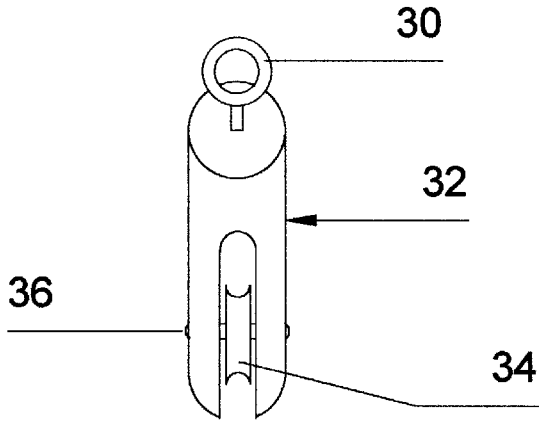
FIG. 4 is a top perspective view of a cord pulley of the tilted window sash support mechanism of FIG. 1.

FIG. 4 is the cord pulley 32 sized to fit within the main tube 22 and move freely through the main tube 22. The cord pulley 32 has an eyelet 30 attached to the top. The pulley wheel 34 is attached by pulley pin 36. The wheel 34 may be omitted in an alternative embodiment with the cord directly running over the pin 36. The pulley may be a device as simple as a cylinder (attached to the spring) with a diametrical opening where through the cord passes and has its direction turned.

FIGS. 5–8 show the sash-mounting block 52 with two mounting holes 50 drilled side by side, and centered at one end, through the sash-mounting block 52. The primary entry hole 38 extends from the opposite end and through the side of the sash mounting block 52 to an intersecting point with the bottom of the first exit hole 40 located within the sash mounting block 52. The first exit hole 40 extends from the top of the sash-mounting block 52 to the same internal intersecting point. The secondary exit hole 44 passes through the sash-mounting block 52. Holes 38, 40, 44 extend in a line. The primary exit hole 48 and the secondary exit hole 46 extend in an identical manner as holes 38 and 40. The first exit hole 42 extends in a like manner as hole 44. Holes 48, 46, 42 extend in a line.

FIG. 6 shows a side view of the sash mounting block 52 and the manner in which the holes are formed into the sash-mounting block 52.

Figure 7:
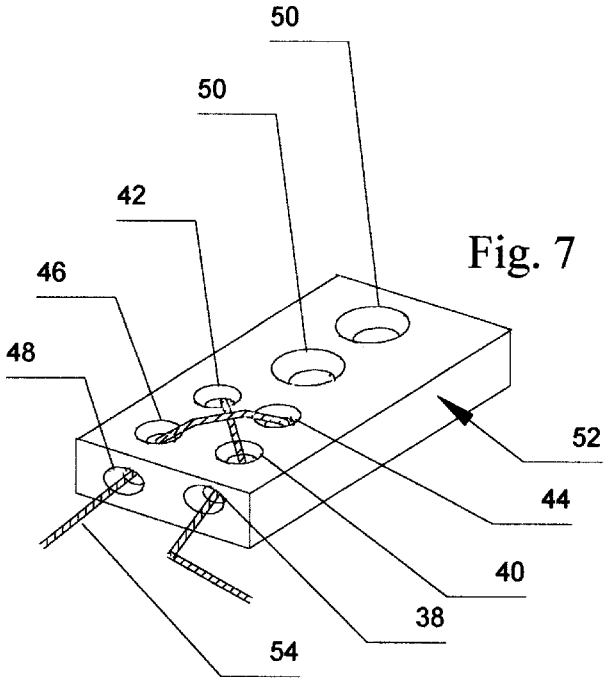

FIGS. 7 and 8 show the path of the flexible cord 54 as it is threaded through the sash-mounting block 52. The flexible cord 54 enters the primary entry hole 38 and exits through the first exit hole 40 and then crosses over to the first entry hole 42. The cord 54 continues through and out the bottom of hole 42 and into the bottom of the second exit hole 44. As the cord 54 exits hole 44, it crosses over itself and into the second entry hole 46 continuing through and out primary exit hole 48.

Threading the flexible cord 54 through the sash-mounting block 52 in this manner restricts the flexible cord 54 to traveling in only one direction. When tension (arrow 53) is placed on the flexible cord 54 that exits through the primary exit hole 48, the overlapping of the flexible cord prevents any movement of the flexible cord 54. Conversely, when tension is applied (arrow 55) to the flexible cord 54 where it enters the primary entry hole 38, the cord 54 will move freely through the sash-mounting block 52 thus allowing for adjustment (shortening) of the active length of the flexible cord 54.

FIG. 7 is a perspective view showing the sash-mounting block 52 and a different perspective of the path of the flexible cord 54.

FIG. 1 is an exploded view of the invention wherein the components are assembled in their proper order. The top-mounting stopper 10 attaches to the extension spring 26 via eyelets 14 and 24. Eyelets 28 and 30 attach the extension spring 26 and the cord pulley 32 to one another. The flexible cord 54 is attached to the sash-mounting block 52 (as stated in the above paragraphs) after it exits the primary exit hole 48. The flexible cord 54 travels through the outlet hole 16 in the bottom-mounting stopper 20 and in an upward direction to (See FIG. 3.) and through the main tube 22 where it travels over the pulley wheel 34 and back down the main tube 22. The end 55 of the flexible cord 54 is held in place by the insertion of the tapered surface 17 of the bottom-mounting stopper 20 into the bottom of the main tube 22.

Figure 9:
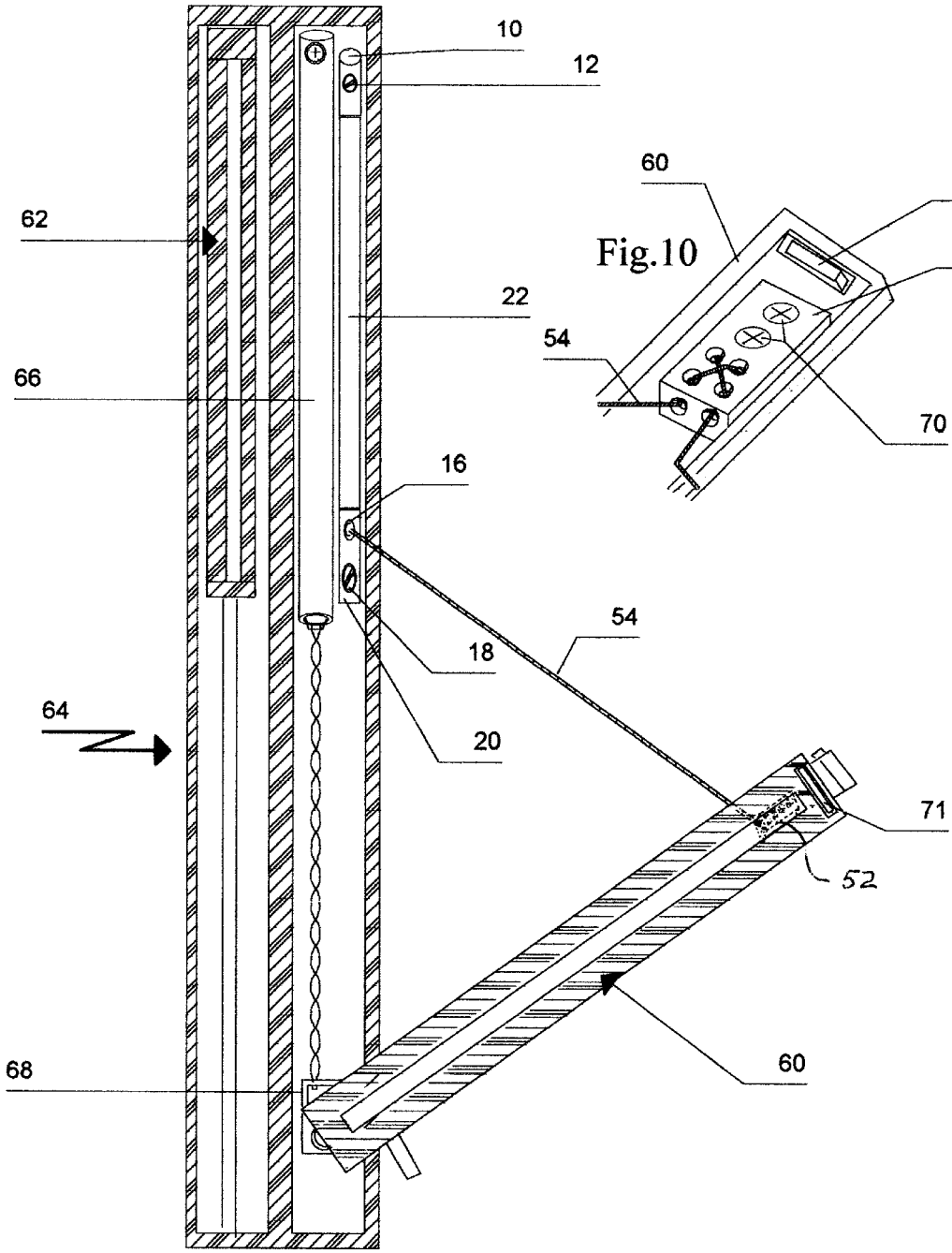
FIG. 9 is a side elevation view, partially in section, of the invention positioned in a double-hung window with bottom the sash of the window supported in a tilted position.

FIG. 9 is a side elevated view in section of a conventional double-hung tilt type window 64 with a top sash 62 and a bottom sash 60. The invention is shown in the inner position: that is, the bottom sash 60 is tilted into a room so that its normally exterior surface can be readily washed. The invention can be placed on either side of the window balance 66, which is not a novel part of the present invention. The invention is mounted, for example, screwed, to the jamb of the window assembly 64 through the mounting hole 12 on the top-mounting stopper 10 and through the mounting hole 18, for example, using screws, on the bottom-mounting stopper 20. The flexible cord 54 is shown supporting the bottom sash 60 as the sash is tilted into the interior of the house. The balance shoe 68 (a conventional element of the window assembly 64) supports and holds the bottom of the bottom sash 60 in its vertical position as the bottom sash 60 rotates (tilts) on its axis.

Figure 10:
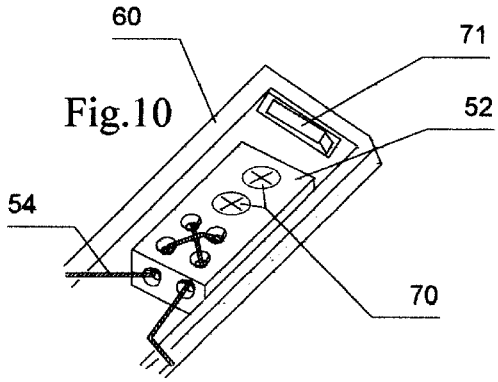
FIG. 10 is a perspective view of the mounting block of FIGS. 6 and 7 positioned on the window sash of FIG. 9.

FIG. 10 shows the sash-mounting block 52 as it is mounted using screws 70 to the side of the bottom sash 60 through the two mounting holes 50. The sash-mounting block 52 is attached at the upper portion of the bottom sash 60 just below the conventional keeper latch 71 of the window sash.

Figure 11:
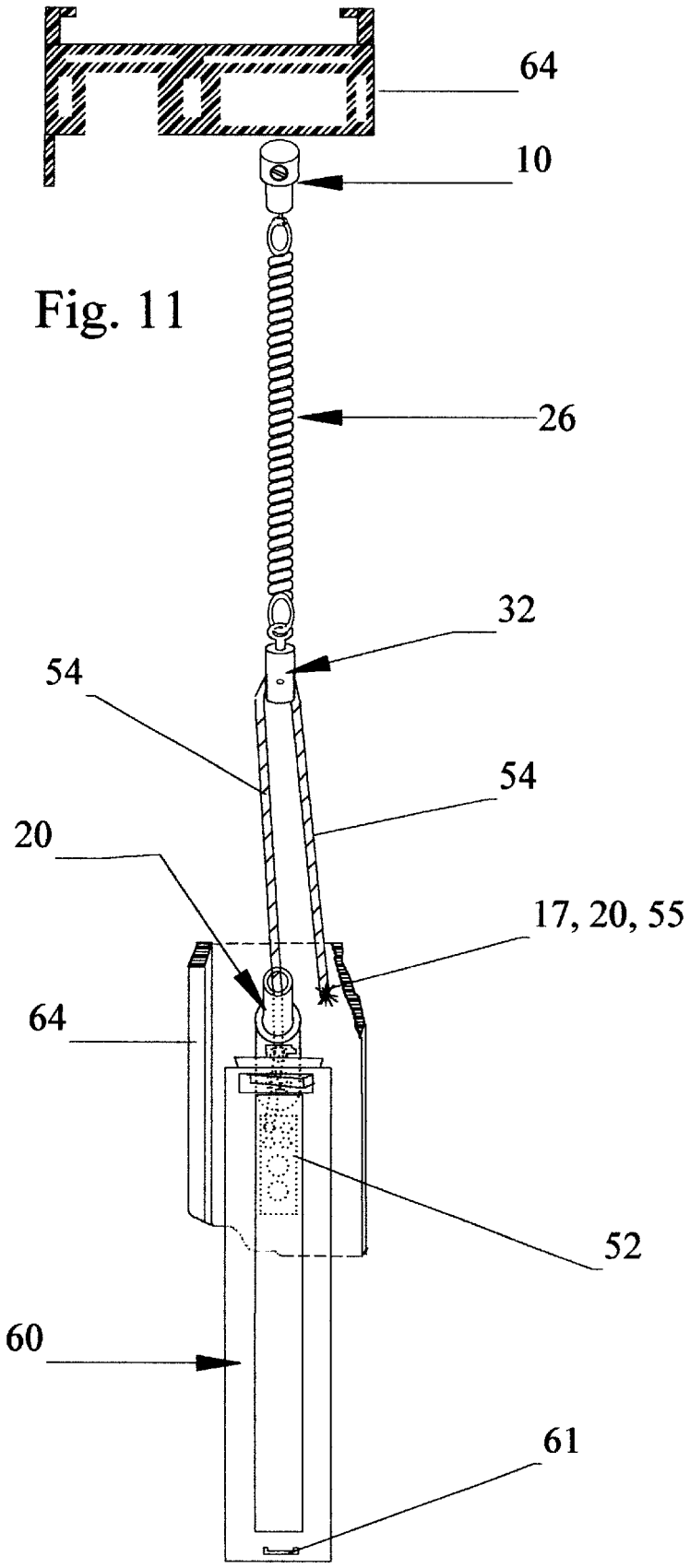
FIGS. 11 and 12 are schematic representations of the embodiment of FIGS. 1 and 9.
Figure 12:
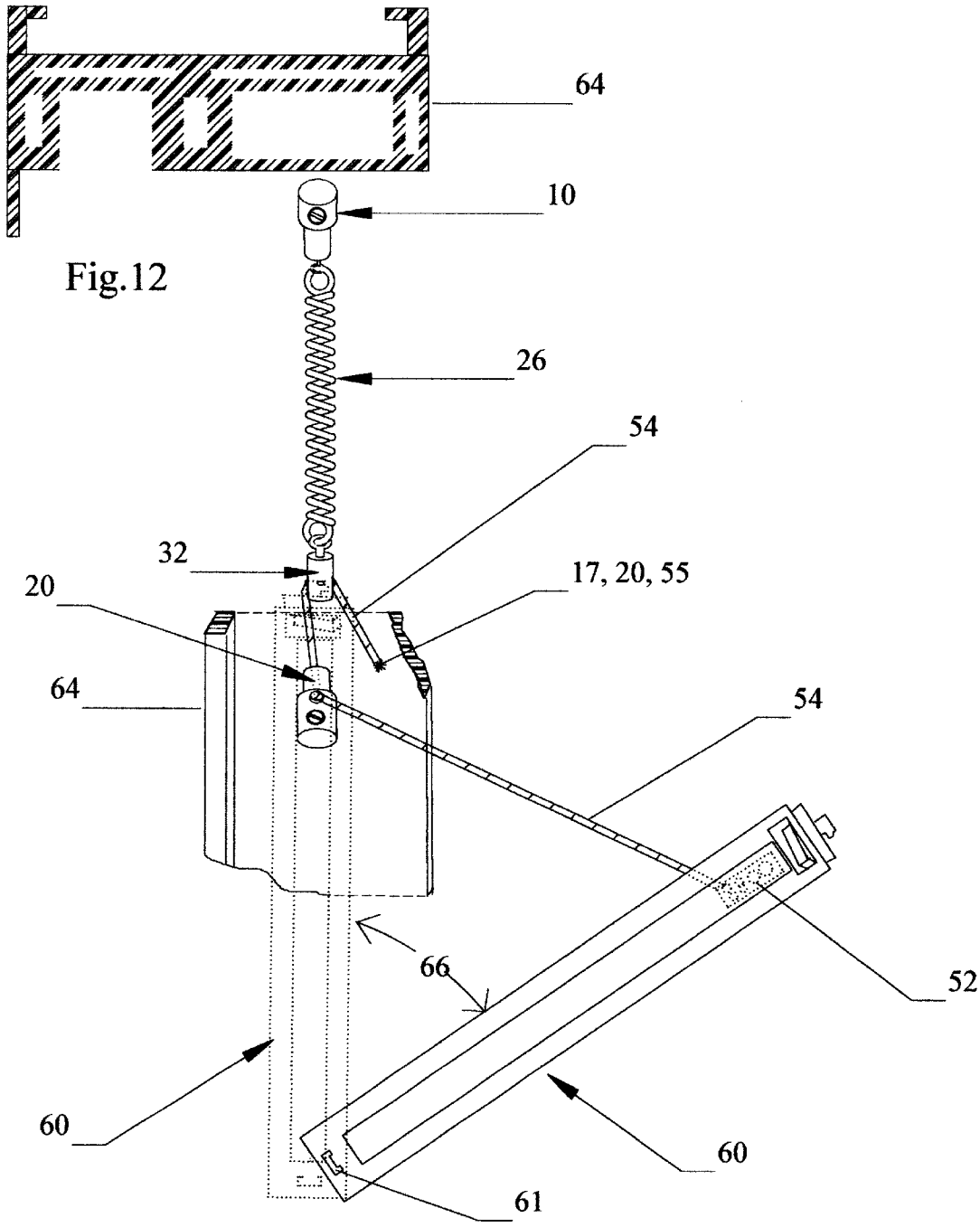

With reference to FIGS. 1, 9, 11, and 12, operation of the invention in a conventional double hung window with tiltable sashes is now described. FIG. 12 is a schematic equivalent of FIG. 9 with the lower sash 60 tilted into a room for cleaning. FIG. 11 illustrates schematically the same sash 60 in the normal upright, vertical position. Corresponding reference numerals are used in the Figures and the tube 22 is omitted schematically for the sake of clarity in illustration. It should be understood that in a conventional design the window assembly includes two sashes, one above the other. Each sash can be individually raised and lowered, and each sash can be individually tilted. In the illustrated (FIG. 9) double hung window assembly, the present support mechanism cooperates with the lower sash.

In FIG. 11 the sash 60 is vertical. The spring 26 is in a contracted state with the pulley 32 located at a middle distance between the stoppers 10, 20 that are fixed to the frame of the window assembly 64. As the sash is tilted and the angle 66 from the vertical increases, the cord 54 is drawn through the pulley 32, and the spring is elongated. The sash rests in position for cleaning of the normally external surface (now face up) when the motion of the pulley 32 downward is stopped by contact with the fixed element (stopper) 20. It should be noted that the resisting force exerted by the spring 26 increases as it stretches and the sash 60 increasingly tilts from the vertical. Thus it is possible to stop the sash 60 at many intermediate angles 66 between the vertical and its lowest resting position. The weight of the sash maintains the tilted sash position and both hands are free for cleaning the window sash. The present invention described above was evaluated using a vinyl double hung window manufactured by Silver Line of New Brunswick, N.J., Series 8500 (24 by 36). The spring was 302 stainless steel, 3/16 inch OD, with an initial tension of 0.94 pounds, and a maximum extension of 6.75 inches.The cord was 0.045" polyester and the tubing was 3/8 " OD plastic.

In an alternative embodiment (not shown) the pulley 32 may be omitted and the end of the cord 54 that is not attached to the sash 60 is attached to the lower end of the spring 26. However such an arrangement requires a much longer spring and a substantially doubled spring extension for the same angle of sash tilting in comparison to the construction in FIG. 1. Conversely, in alternative embodiments of the invention, the amount of spring extension can be reduced for the same sash tilt by using, for example, pulley 32 in conjunction with another pulley (not shown) at the stopper 20. The cord from the sash 60 enters tube 22 through stopper 20, rises in the tube and makes one loop over the pulley 32 at the spring. The cord then extends down and loops around the pulley at stopper 20 and again extends up the tube 22 and attaches either to the stopper 10 or to the fixed portion of pulley 32.

Figure 13:
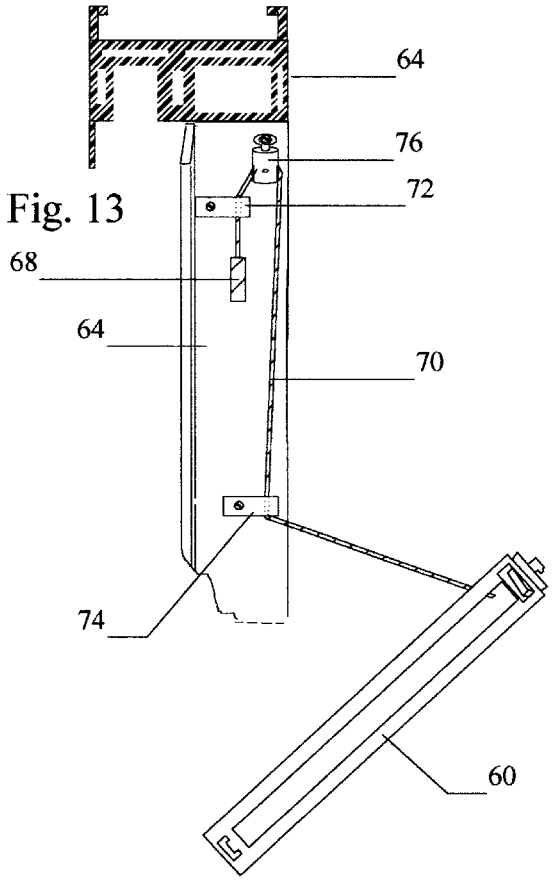
FIGS. 13 and 14 are schematic representations of alternative embodiments in accordance with the invention.
Figure 14:
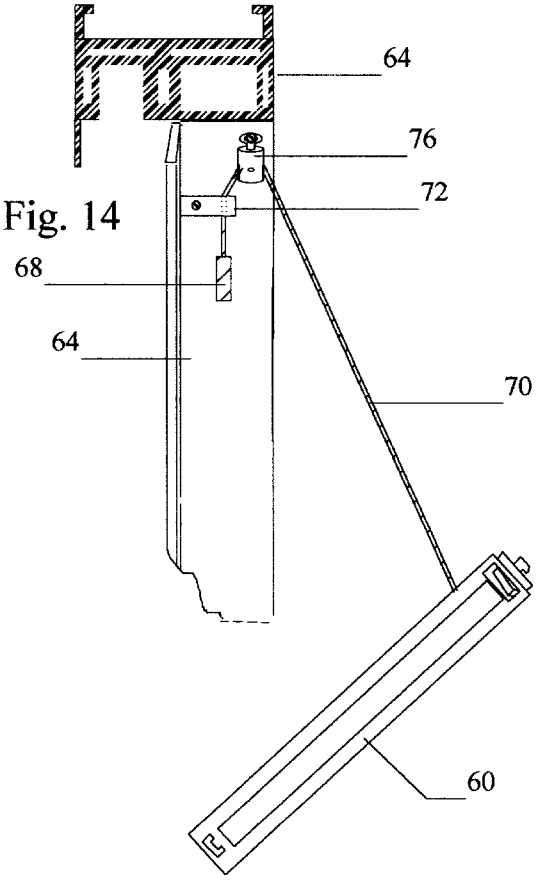

FIG. 13 illustrates another embodiment in accordance with the invention wherein the sash 60 is connected to a counterweight 68 by a cord 70 by way of guides 72, 74 and a pulley 76, all fixed to the frame of the window 64. The embodiment in accordance with the invention of FIG. 14 is similar to FIG. 13 except that the cord 70 extends directly from the pulley 76 to the sash 60. The counterweight 68 may move freely in a vertical tube as in FIG. 1 to prevent unwanted lateral movements and entanglement. The weight 68 tensions the cord, and the guide 72 limits the maximum sash tilt angle.

In every embodiment of the invention the cord is maintained in tension whether by a spring, counterweight, or other tensioning device. This tension makes for stabilized, smooth motion of the sash as it is being down-tilted and when later returned to the vertical position. The cord is not slack. In the embodiment of FIGS. 1, 11, 12 including the intermediate spring 26 and pulley 32, the tension force alone will hold the sash stationary at small tilt angles 66. Thus, the sash 60 will not swing downward of its own weight, uncontrolled, if inadvertently a person fails to properly latch the sash when they move it into its vertical position. This is a significant practical advantage.

In alternative embodiments of the invention, the linear spring 26 may be replaced with a coiled spring (not shown) as used, for example, in retracting tape measures.

What is claimed is:

1. A support mechanism for a window assembly having a sash tiltable for cleaning, said sash having opposed lateral edges and a tilting axis extending between said lateral edges proximate a lower edge of said sash, and an upper edge of said sash being rotatable about said axis when said upper edge is unrestrained, said support mechanism comprising:

a cord of extended length having a first end for connection to said sash proximate one said lateral edge;

a tensioning unit for mounting to a frame of said window assembly and connected to said cord;

a guide element for connection to said frame of said window assembly and for defining a path for said cord between said attachment to said sash and said tensioning unit, said tensioning unit, when said support mechanism is installed in said window assembly, producing tension in said cord when said sash is in a position tilted about said axis from a normal restrained position that is generally parallel to said frame of said window assembly, said cord supporting said sash stationary at a tilted position, said stationary tilted position being determined at least in part by an active portion of said extended length of said cord;

a cord adjustment mechanism connected to said cord for adjusting said active portion of said length to allow selection of said stationary tilted position.

2. A support mechanism for a window assembly having a sash tiltable for cleaning, said sash having opposed lateral edges and a tilting axis extending between said lateral edges proximate a lower edge of said sash, and an upper edge of said sash being rotatable about said axis when said upper edge is unrestrained, said support mechanism comprising:

a cord of extended length having a first end for connection to said sash proximate one said lateral edge;

a tensioning unit for mounting to a frame of said window assembly and connected to said cord;

a guide element for connection to said frame of said window assembly and for defining a path for said cord between said attachment to said sash and said tensioning unit, said tensioning unit, when said support mechanism is installed in said window assembly, producing tension in said cord when said sash is in a position tilted about said axis from a normal restrained position that is generally parallel to said frame of said window assembly, said cord supporting said sash stationary at a tilted position, wherein said tensioning unit includes a spring for connection at one end to said frame, said support mechanism further comprising a pulley, an other end of said spring connecting to said pulley, said cord connecting to said spring by passing through said pulley, in use a second end of said cord being connected to said frame, whereby tilting said sash causes said cord to move over said pulley and said pulley extends said spring.

3. A support mechanism as in claim 2, further comprising a stop for connection to said frame, said stop blocking a travel path of said pulley and of said an other end of said spring, in use an angle of tilting of said sash being terminated by said pulley contacting said stop.

4. A support mechanism as in claim 3, further comprising a tubing, said spring and said pulley being within and guided in motion by said tubing, said guide element being connected to a first end of said tubing and having said path for said cord, a second end of said tubing being connectable to said window frame.

5. A support mechanism as in claim 4, wherein said guide element includes said stop.

6. A support mechanism as in claim 3, further comprising a mounting block for connecting said first end of said cord to said sash, said mounting block being directly connectable to said sash and adjustably connected to said cord, an active portion of said cord extending from said mounting block to said second end of said cord, said cord being threaded through a plurality of openings in said block and crossing over itself, said active portion being shortened by pulling said first cord end in one direction through said block, said crossing over preventing pulling said cord through said block in a second direction opposite to said first direction.

7. A support mechanism for a window assembly comprising:

a window assembly having a frame and a sash tiltable in said frame for cleaning, said sash having opposed lateral edges and a tilting axis extending between said lateral edges proximate a lower edge of said sash, and an upper edge of said sash being rotatable about said axis when said upper edge is unrestrained;

a cord of extended length having a first end for connection to said sash proximate one said lateral edge;

a tensioning unit for mounting to said frame of said window assembly and connected to said cord;

a guide element for connection to said frame of said window assembly and for defining a path for said cord between said attachment to said sash and said tensioning unit, said tensioning unit producing tension in said cord when said sash is in a position tilted about said axis from a normal restrained position that is generally parallel to said frame of said window assembly said cord supporting said sash stationary at a tilted position, said stationary tilted position being determined at least in part by an active portion of said extended length of said cord; and a cord adjustment mechanism connected to said cord for adjusting said active portion of said length to allow selection of said stationary tilted position.

8. A support mechanism for a window assembly comprising:

a window assembly having a frame and a sash tiltable in said frame for cleaning, said sash having opposed lateral edges and a tilting axis extending between said lateral edges proximate a lower edge of said sash, and an upper edge of said sash being rotatable about said axis when said upper edge is unrestrained;

a cord of extended length having a first end for connection to said sash proximate one said lateral edge;

a tensioning unit for mounting to said frame of said window assembly and connected to said cord;

a guide element for connection to said frame of said window assembly and for defining a path for said cord between said attachment to said sash and said tensioning unit, said tensioning unit producing tension in said cord when said sash is in a position tilted about said axis from a normal restrained position that is generally parallel to said frame of said window assembly, said cord supporting said sash stationary at a tilted position, wherein said tensioning unit includes a spring for connection at one end to said frame, said support mechanism further comprising a pulley, an other end of said spring connecting to said pulley, said cord connecting to said spring by passing through said pulley, a second end of said cord being connected to said frame, tilting said sash causes said cord to move over said pulley and said pulley extends said spring.

9. A support mechanism as in claim 8, further comprising a stop for connection to said frame, said stop blocking a travel path of said pulley and of said an other end of said spring, an angle of tilting of said sash being terminated by said pulley contacting said stop.

10. A support mechanism as in claim 9, further comprising a tubing, said spring and said pulley being within and guided in motion by said tubing, said guide element being connected to a first end of said tubing and having said path for said cord, a second end of said tubing being connected to said window frame.

11. A support mechanism as in claim 10, wherein said guide element includes said stop.

12. A support mechanism as in claim 9, further comprising a mounting block for connecting said first end of said cord to said sash, said mounting block being directly connected to said sash and adjustably connected to said cord, an active portion of said cord extending from said mounting block to said second end of said cord, said cord being threaded through a plurality of openings in said block and crossing over itself, said active portion being shortened by pulling said first cord end in one direction through said block, said crossing over preventing pulling said cord through said block in a second direction opposite to said first direction.

13. A support mechanism for a window assembly having a frame and a sash tiltable for cleaning, said sash having opposed lateral edges and a tilting axis extending between said lateral edges proximate a lower edge of said sash, and an upper edge of said sash being rotatable about said axis when said upper edge is unrestrained, said support mechanism comprising:

a tubing having at a first end a first stopper blocking said tubing, and at a second end a second stopper blocking said tubing;

a spring within said tubing connected at one spring end to said first stopper;

a pulley on a support within said tubing, an other end of said spring connecting to said spring support;

a cord passing through said pulley, a first end of said cord being connected to said second stopper, a second end of said cord being external of said tubing for connection to said sash, said cord entering said tubing at said second stopper and extending to said pulley, said spring producing tension in said cord when said sash is in a position tilted about said axis from a normal restrained position that is generally parallel to said frame of said window assembly, said cord supporting said sash stationary at a tilted position; and a mounting block for connecting said second end of said cord to said sash, said mounting block being directly connectable to said sash and adjustably connected to said cord, an active portion of said cord extending from said mounting block to said first end of said cord, said cord being threaded through a plurality of openings in said block and crossing over itself, said active portion being shortened by pulling said second cord end in one direction through said block, said crossing over preventing pulling said cord through said block in a second direction opposite to said first direction.

14. A support assembly as in claim 13, wherein said second stopper serves as a stop within said tubing for said pulley, tilting said sash, in use, causing said cord to move over said pulley and said pulley extends said spring.

15. A support mechanism as in claim 13, wherein said stationary tilted position is determined at least in part by said active portion of said extended length of said cord.

* * * * *